US010249997B1

(12) United States Patent
Vellucci

(10) Patent No.: US 10,249,997 B1
(45) Date of Patent: Apr. 2, 2019

(54) JUMPER WITH SAFETY FUSE

(71) Applicant: Dominick Vellucci, Bronx, NY (US)

(72) Inventor: Dominick Vellucci, Bronx, NY (US)

( * ) Notice: Subject to any disclaimer, the term of this patent is extended or adjusted under 35 U.S.C. 154(b) by 0 days.

(21) Appl. No.: 15/806,894

(22) Filed: Nov. 8, 2017

(51) Int. Cl.
*H01R 31/06* (2006.01)
*H01R 13/46* (2006.01)
*H01R 13/68* (2011.01)

(52) U.S. Cl.
CPC ..... *H01R 31/06* (2013.01); *H01R 13/465* (2013.01); *H01R 13/68* (2013.01)

(58) Field of Classification Search
CPC ..... G01R 1/06788; G01R 1/06738; G01R 31/026; G01R 19/155; G01R 1/06772; G01R 31/041; H01R 11/24; H01R 13/68; H01R 2201/20; H01R 11/18
See application file for complete search history.

(56) References Cited

U.S. PATENT DOCUMENTS 4,041,380 A * 8/1977 Epstein ..... G01R 1/06788 324/508
4,391,485 A 7/1983 Urani
4,969,834 A 11/1990 Johnson
5,772,473 A * 6/1998 Cheng ..... H01H 85/201 439/620.34
6,577,116 B2 * 6/2003 Wollert ..... G01R 19/155 324/133
8,342,885 B2 1/2013 Jetton
8,979,600 B2 3/2015 Von Zur Muehlen et al.
9,325,122 B1 4/2016 Goyal
2009/0174394 A1 * 7/2009 Armstrong ..... G01R 1/36 324/115
2012/0161919 A1 6/2012 Von Zur Muehlen
2012/0309232 A1 12/2012 Darr et al.

* cited by examiner

*Primary Examiner* — Ross N Gushi
(74) *Attorney, Agent, or Firm* — Jie Tan; JT Law Services, PC

(57) ABSTRACT

A jumper with safety fuse. The jumper includes first and second conducting wires and a fuse assembly interposed therebetween and connected thereto. A connector assembly is connected to each of the first and second conducting wires, which includes a plug section and a receptacle section. The plug section includes a body, a lead connector extending from a top of the body, and a plug extending from a base of the body. The receptacle section includes a socket configured to receive the plug and conduct electricity to its corresponding conducting wire, thereby forming an electrical connection therebetween. The jumper may be provided in a jumper kit with jumpers of different gauges and a set of interchangeable lead connectors.

11 Claims, 5 Drawing Sheets

JUMPER WITH SAFETY FUSE

TECHNICAL FIELD

The present disclosure relates generally to jumper wires. More particularly, the present disclosure relates to a jumper with safety fuse and a jumper kit with different gauge jumper wires and interchangeable lead connectors.

BACKGROUND

Pinpointing the exact cause of trouble in an electrical circuit is most times accomplished by the use of special test equipment. Jumper wires are simple, yet extremely valuable, pieces of test equipment. They are basically test wires which are used to bypass sections of a circuit.

Jumper wires are used primarily to actuate a portion of a circuit for the sake of testing, or to locate open electrical circuits, on either the negative or ground (–) side of the circuit or on the positive (+) side. For example, if an electrical component fails to operate, a technician would connect the jumper wire between the component and a good ground. If the component operates only with the jumper installed, the ground circuit is open. If the ground circuit is good, but the component does not operate, the circuit between the power feed and component may be open. By moving the jumper wire successively back from the component toward the power source, one can isolate the area of the circuit where the open is located. When the component stops functioning, or the power is cut off, the open is in the segment of wire between the jumper and the point previously tested. In addition, a certain component being tested might be connected to a timer or control circuit and will normally only actuate under certain conditions or at a certain time. To test that component, a jumper would be used to bypass the timer or control circuit.

Although jumper wires are a commonly used tool, there are many potential hazards associated with their use, such as accidentally causing a "dead short" or ground fault. Unfortunately, these electrical hazards often lead to serious injury from shock or even death. In cramped, hard-to-reach areas, it becomes especially difficult to test electrical components and the risk of electric shock becomes even greater.

There is therefore a need for jumper wires that incorporate a safety component to help protect people and equipment from short circuits or ground faults.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide safer jumper wires to protect workers and equipment from a short circuit or "dead short." Accordingly, the present disclosure provides a jumper that includes a fuse. In the event of a short circuit, the fuse will melt, blow, or disintegrate and prevent harm or damage to people and equipment in contact with or connected to the jumper.

It is another aspect to provide a jumper with interchangeable connectors for troubleshooting problems with electrical equipment, such as components on a circuit board. Since the jumper leads can be used to connect different parts of a circuit or to check if components are working properly, the right type of connector might be unavailable, forcing technicians to inadvisably use their hands to maintain electrical contact between a lead connector and an electrical component. Accordingly, the jumper kit is therefore provided with a variety of different lead connectors for connecting to different types of electronic components, allowing technicians to use their hands for other tasks. In addition, each lead connector can be easily plugged in or unplugged from the jumper as needed.

It is another aspect to provide a set of jumpers to handle different amounts of current, such as low, medium, or high current circuits. Whenever a circuit is extended or rewired, or when any new circuit is installed, it is critical that the new wiring is made with wire conductors that are properly sized for the amperage rating of the circuit. Higher amperage circuits require wires of larger diameter to avoid excessive heat and reduce the danger of fire. In smaller wires, too much current flowing through them creates excessive resistance and more heat. Accordingly, the jumper kit of the present aspect may include jumpers having different gauges of wire for handling different amperage circuits.

The present disclosure addresses at least one of the foregoing disadvantages associated with conventional jumpers. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
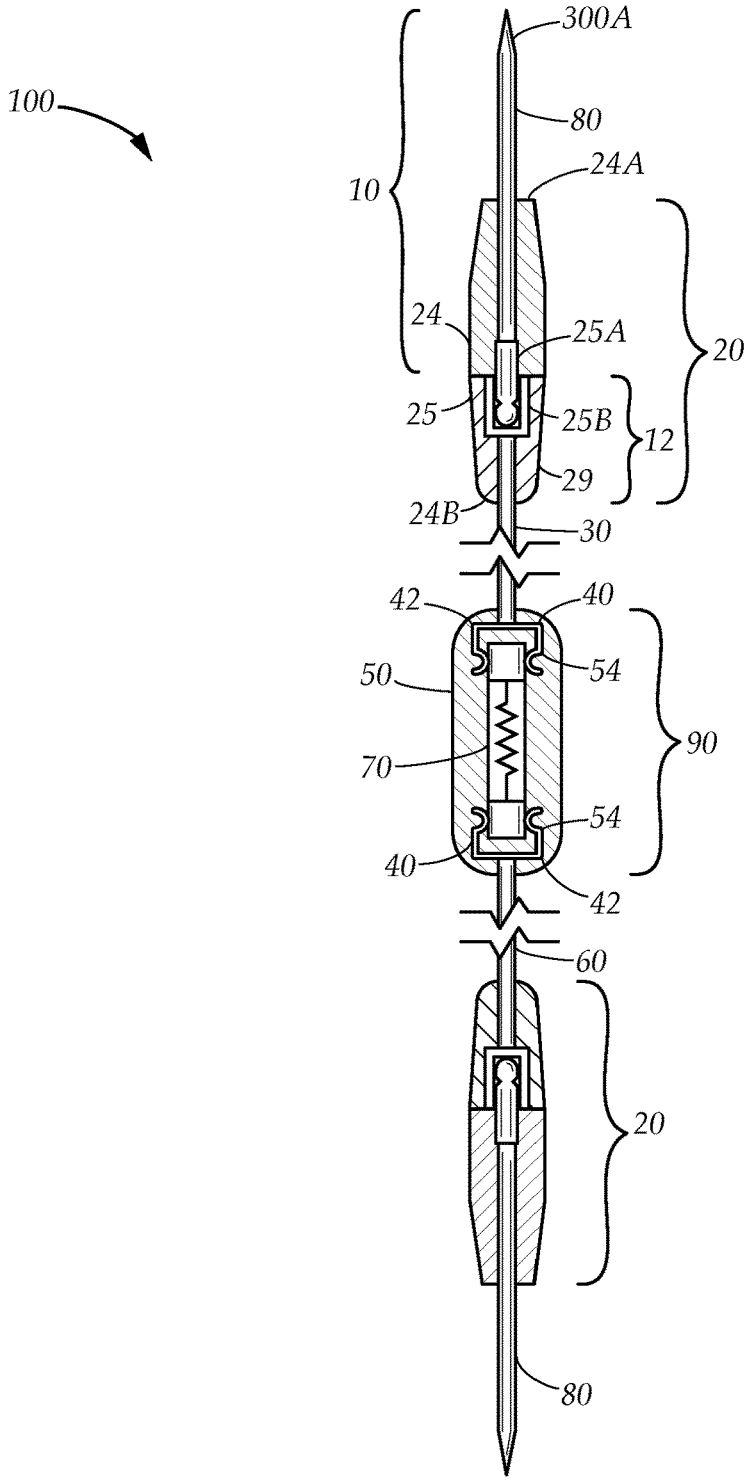
FIG. 1 is a top plan view with parts broken away of a jumper with safety fuse according to an embodiment of the invention.

FIG. 1 illustrates a jumper with safety fuse 100 (hereinafter "jumper"). The jumper 100 includes a first conducting wire 30 and a second conducting wire 60 with a fuse assembly 90 therebetween and connected thereto. The jumper 100 includes a pair of lead connectors 80, and a pair of connector assemblies 20. One of the lead connectors 80 is electrically connected to the first conducting wire 30 and the other of the lead connectors 80 is electrically connected to the second conducting wire 60. The lead connectors are located at opposite ends of jumper 100 and are used to physically connect each lead connector 80 to the first conducting wire 30 and second conducting wire 60.

Figure 3:
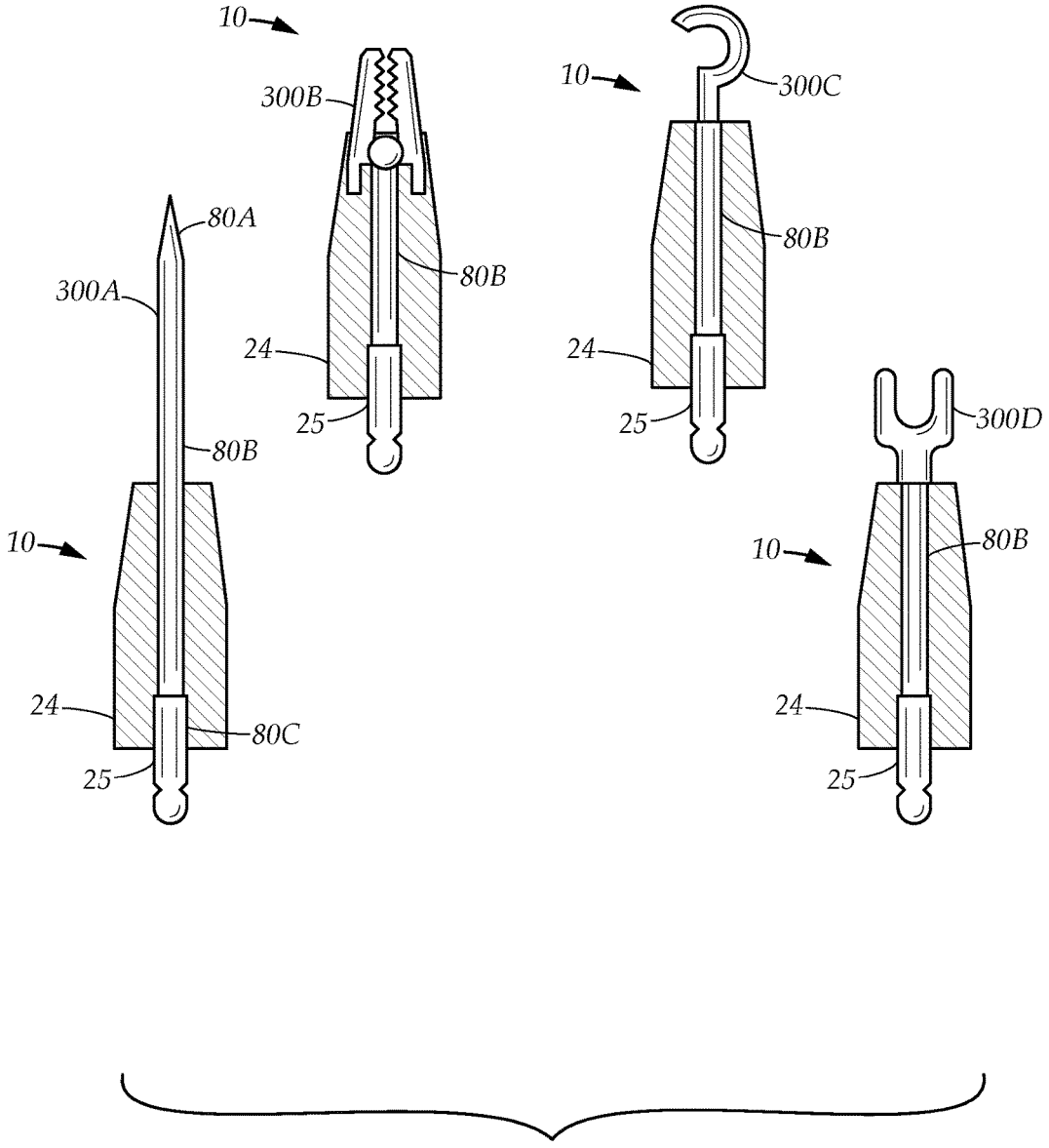
FIG. 3 is a top plan view with parts broken away of different lead connectors according to an embodiment of the invention.

Each connector assembly 20 includes an interchangeable plug section 10 and a receptacle section 12. The plug section 10 includes a body 24 having a top 24*a* and a base 24*b*, with the lead connector 80 extending from top 24*a* of the plug body 24. Referring also to FIG. 3, the lead connector 80 includes a head portion 80*a*, a neck portion 80*b*, and a base portion 80*c*, where the base portion 80*c* defines a plug 25 that extends at least partially from the base 24*b* of plug body 24. Although the illustration of FIG. 1 shows a probe type 300*a* lead connector 80, this is just one option. For example, instead of a probe, the head portion 80*a* of the lead connector 80 may be of several connector types shown in FIG. 3, such as an alligator clip 300*b*, a hook connector 300*c*, a fork connector 300*d*, or any other type of lead connector such as an eyelet connector or spade connector. It should also be noted that the terms "interchangeable plug section" and "interchangeable lead connector" are used interchangeably throughout this application, since the lead connector is part of the interchangeable plug section thus making it an interchangeable lead connector.

As shown in FIG. 1, the receptacle section 12 includes a socket 29 that is electrically connected to one of the first conducting wire 30 and second conducting wire 60. The plug 25 at the base of lead connector 80 includes an elongated member 25*a* with a spherical tip 25*b* that selectively inserts into the socket 29, and is configured to receive the plug 25. The plug 25 may be configured to form a snug fit when inserted into socket 29 such that the plug 25 is frictionally held within the socket until intentionally removed therefrom. Alternatively, the plug 25 may engage a corresponding mating member inside the receptacle section to lock in place. Although FIG. 1 depicts a plug 25 having an elongated member 25*a* with a spherical tip 25*b*, one of ordinary skill in the art will appreciate that the plug may have other shapes as long as it serves the purpose of mating with the socket and conducting current from the lead connector 80 to one of the conducting wires 30, 60.

The fuse assembly 90 includes a fuse 70 and a fuse retention means 40 connected to an end of each respective first and second conducting wires 30, 60 that is opposite from its associated connector assembly 20. The fuse 70 may be barrel shaped, having a pair of terminal ends 54. The fuse retention means 40 is configured to retain the fuse and may be a fuse clip configured to grasp one of the terminal ends 54 of the fuse 70. Having one of the fuse retention means 40 at opposite terminal ends 54 of the fuse secures the fuse 70 and electrically connects said fuse 70 in series between conducting wires 30 and 60.

The fuse 70 has an amperage rating, such that it is designed to withstand a predetermined current before it breaks the circuit in accordance with its current rating. The conducting wires 30, 60 have a gauge, and a current rating that such gauge can safely handle. The current rating of the fuse 70 is selected to be appropriate to the current rating of the conducting wires 30, 60.

The fuse assembly may also include a housing 50 configured to house the fuse. The housing, in turn, may include a cradle configured to retain the fuse 70 inside the housing 50. According to one aspect, the fuse retention means 40, such as clips 42, may be partially or fully enclosed within housing 50 or wrapped in a flexible insulating material, such as plastic. Moreover, the housing or insulating wrap may have an opening for installing or removing the fuse 70. The opening may be permanent, or may be closeable with, for example, a cover that is opened or removed to gain access to the fuse. The cover may be a hinged cover, a slideable cover, or spring-loaded hatch activated by pressing a button. One of ordinary skill in the art will recognize that there are many types of covers that may be used to cover the opening, while providing access to the fuse when needed. In any case, the fuse is removed by accessing the interior of the housing or uncovering/removing the insulated wrap and disconnecting the fuse.

The cradle may have conductive contacts that connect to the terminal ends 54 of fuse 70. The first and second conducting wires 30 and 60 are each connected to a corresponding contact in the cradle to make an electrical connection with said conducting contacts. In this aspect, one or more fuses 70 can be installed in the housing 50 and, if a fuse blows due to excessive amperage, it can easily be removed and replaced. As previously mentioned, the housing 50 may be partly open or may completely enclose the fuse 70 while allowing a user to gain access to the fuse.

Together, the first and second conductive wires 30 and 60, the connector assembly 20, lead connector 80, and fuse assembly 90 form jumper 100. The fuse 70 is connected in series with the first and second conductive wires. The fuse 70 can thus serve its purpose to protect sensitive components, or a technician using the jumper, from harm caused by a short circuit.

Figure 2:
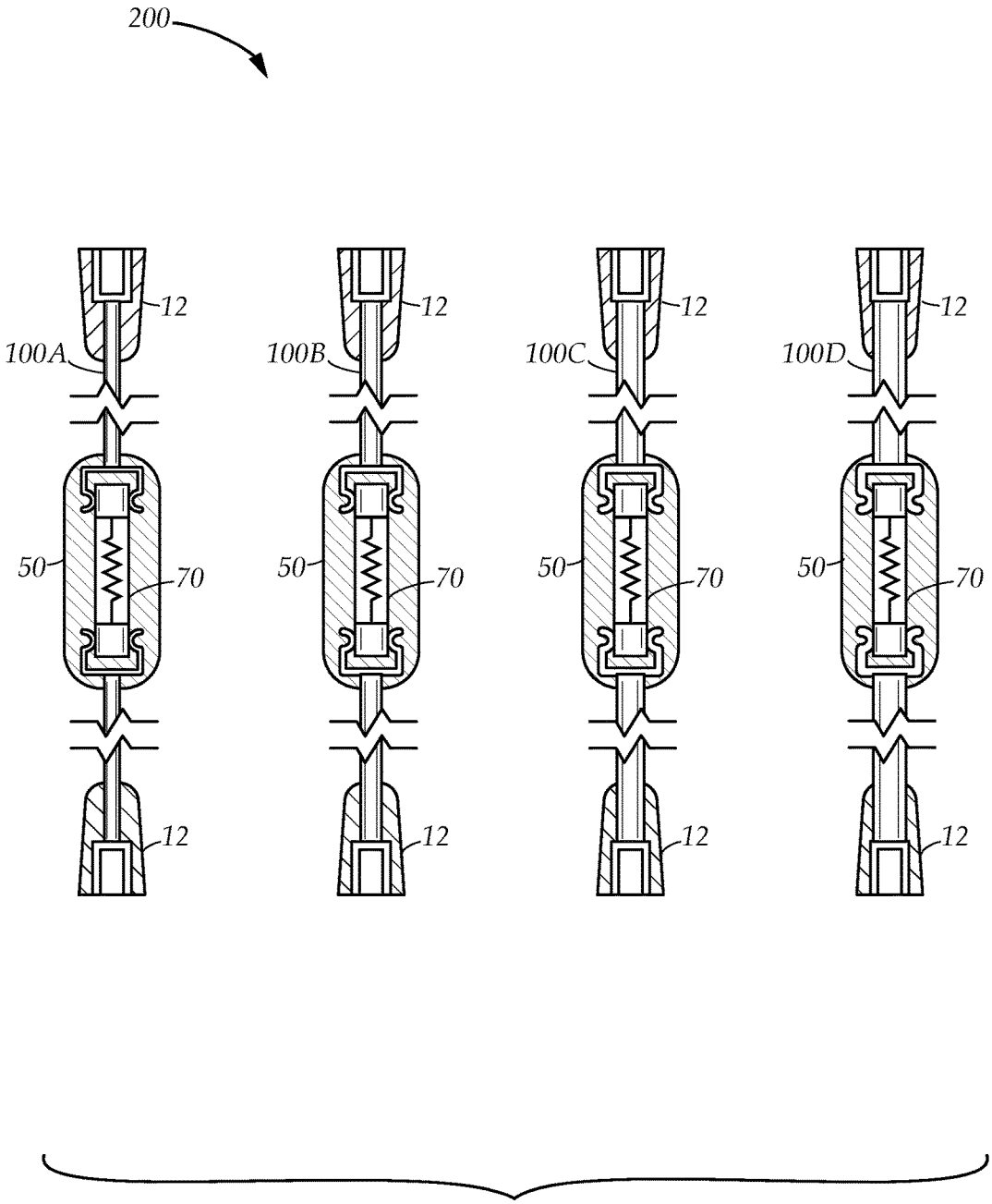
FIG. 2 is a top plan view with parts broken away of a set of jumpers with different wire gauges according to an embodiment of the invention.

FIG. 2 illustrates a jumper kit 200 with four jumpers 100*a*, 100*b*, 100*c*, and 100*d*, but without the plug portions 10 (seen in FIG. 1). Each of said jumpers 100*a*, 100*b*, 100*c*, and 100*d*, have different wire gauges and thus a different current rating. For example, some jumpers in the kit may utilize small gauge wires, others may utilize medium gauge wires, while still others utilize large gauge wires. Each jumper 100 may be identified according to its wire gauge, voltage/current rating, or a serial number.

As discussed above, different types of lead connectors may be used with each jumper in the kit, including probes, alligator clips, eyelet clips, hook connectors, fork connectors, spade connectors, or any other type of connector. In most cases, the same type of connector will be attached to each opposite end of the jumper, but one could attach different types of lead connectors, such as those shown in FIG. 3, to each end of the jumper should the need arise.

As can be seen in FIG. 3, the head 80*a* of each of the lead connectors 300*a-d* has varying configurations, but the neck 80*b* and plug 25 are the same for purposes of interchangeability. Furthermore, the neck 80*b* and plug 25 may be partially embedded in a solid insulating material (e.g., plastic, rubber, wood, cork, etc.) that forms the body 24 of plug section 10.

Figure 4:
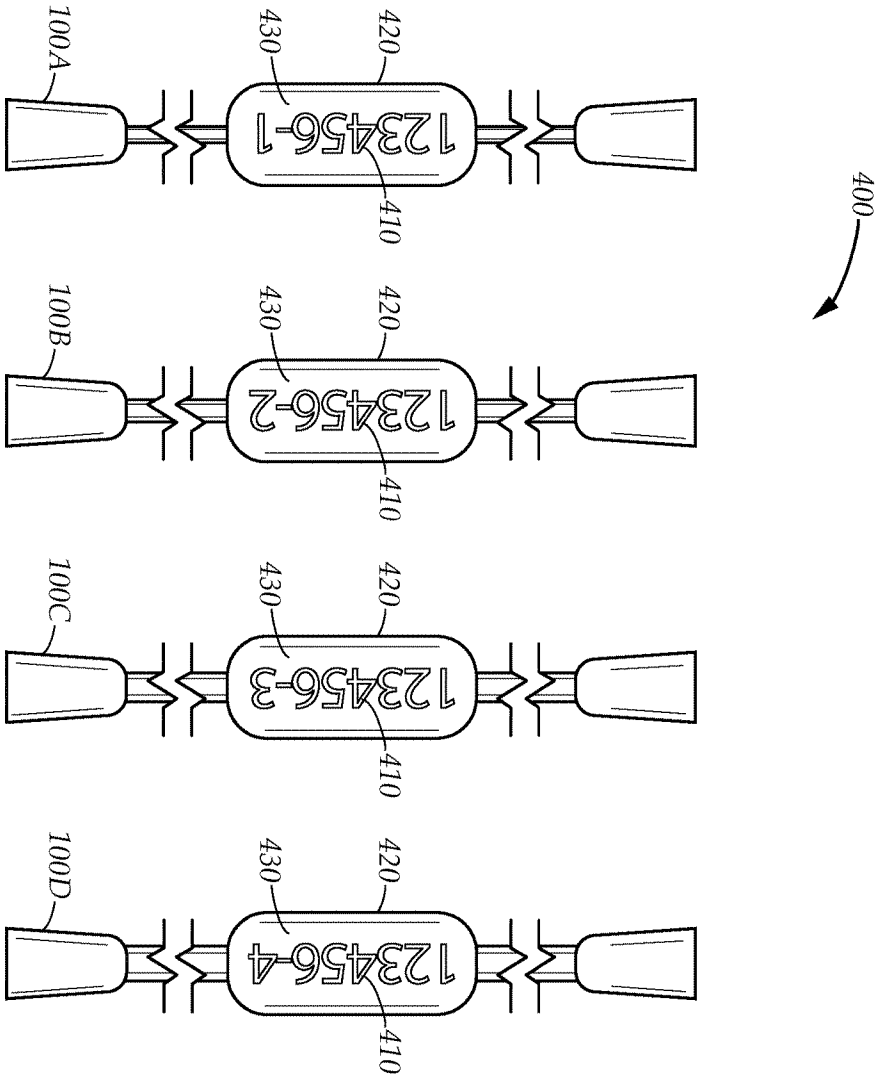
FIG. 4 is a top plan view of a plurality of jumpers with pre-printed indicia for uniquely identifying each jumper.

FIG. 4 illustrates the set of four jumpers 400 each displaying a unique identifier 410, such as the serial numbers shown. In particular, the set 400 has a unique serial number, and each jumper 100*a*, 100*b*, 100*c*, and 100*d* has a unique serial number. The jumper kit 400 may be assigned to a technician and each jumper in the kit displays an identifier associated with that technician. The displayed identifier 410 in this aspect is a preprinted serial number affixed to the jumper. Use of a jumper from a particular kit can be traced to its assigned technician. Accordingly, if an incident/mishap occurs, the jumper can be traced back to the technician to which it was assigned.

Although FIG. 4 shows an identifier 410 in the form of a serial number displayed on each jumper, one of ordinary skill will readily appreciate that the identifier may be a number, letters, symbols, or any combination thereof. In addition, the displayed serial number allows a technician to quickly determine whether the jumper is assigned to him/her or someone else.

Figure 5:
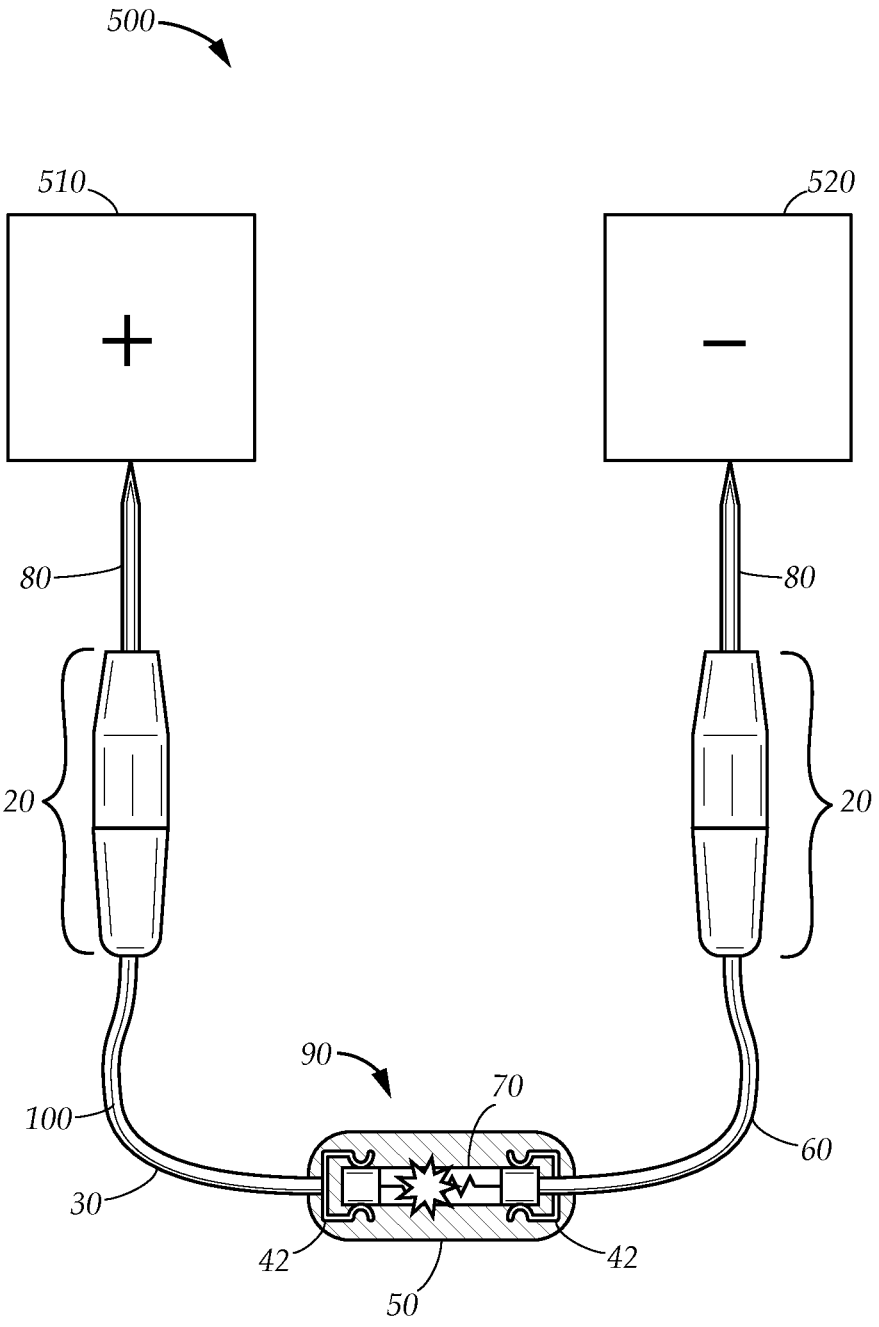
FIG. 5 is a top plan view with parts broken away, illustrating the jumper being used in testing a piece of electrical equipment.

FIG. 5 illustrates a probe type jumper being used to test an item of electrical equipment 500, having a first terminal 510 and a second terminal 520. The lead connectors 80 are in contact with the first terminal 510 and second terminal 520 of the electrical equipment 500. As shown in FIG. 5, in the event of an overload caused by a short circuit, a large current will flow through the jumper 100 that will exceed the rated current for the first conducting wire 30 and second conducting wire 60, and thus the rated capacity for the fuse 70. Accordingly, the fuse 70 will blow, breaking the circuit through the jumper 100 and preventing harm to people and equipment.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a jumper apparatus and a jumper kit. The disclosure is illustrated by example in the drawing figures, and throughout the written description. It should be understood that numerous variations are possible, while adhering to the inventive concept. Such variations are contemplated as being a part of the present disclosure.

What is claimed is:

1. A jumper kit comprising:

a plurality of jumpers wherein each jumper comprises:

a first conducting wire and a second conducting wire, the first conducting wire and second conducting wire having a gauge and a rated current that is the same for each of said first conducting wire and second conducting wire but is different from the first conducting wire and second conducting wire of any of the other jumpers in the kit;

a fuse assembly interposed between the first and second conducting wires and connected thereto;

a connector assembly connected to each of the first and second conducting wires, the connector assembly comprising a plug section and a receptacle section, wherein the plug section includes:

a body, a lead connector extending from a top of the body, and a plug extending from a base of the body; and wherein the receptacle section includes:

a socket configured to receive the plug and conduct electricity to its corresponding conducting wire, thereby forming an electrical connection therebetween.

2. The jumper kit as described in claim 1, wherein each different gauge jumper has either a different or the same amperage capacity.

3. The jumper kit as described in claim 2, wherein the fuse assembly comprises:

a fuse;

a fuse retention means connected to an opposite end of each respective first and second conducting wires, wherein the fuse retention means is configured to retain the fuse.

4. The jumper kit as described in claim 3, wherein the fuse assembly further comprises a housing configured to house the fuse.

5. The jumper kit as described in claim 4, wherein the fuse has a pair of terminal ends, and wherein the fuse retention means is a clip configured to grasp the terminal end of the fuse.

6. The jumper kit as described in claim 5, wherein each lead connector is selected from the group consisting of: a probe, an alligator clip, an eyelet clip, a hook connector, and a fork connector.

7. The jumper kit as described in claim 6, wherein each jumper comprises printed indicia bearing a serial number that uniquely identifies said jumper, such that said serial number is different from the serial number on any other jumper kit.

8. The jumper kit as described in claim 1, wherein each different gauge jumper has a varying amperage capacity.

9. The jumper kit as described in claim 1, wherein each jumper is of the same or a varying gauge.

10. The jumper kit as described in claim 1, wherein each jumper is of different sizes.

11. The jumper kit as described in claim 1, wherein each jumper comprises printed indicia bearing a serial number that uniquely identifies said jumper, such that said serial number is different from the serial number on any other jumper kit.

* * * * *